US006257205B1

(12) United States Patent
Calvas et al.

(10) Patent No.: US 6,257,205 B1
(45) Date of Patent: Jul. 10, 2001

(54) SYSTEM FOR CONTROLLING A FUEL INJECTOR

(75) Inventors: George Tom Calvas, Dearborn; Robert J. McCarthy, Grosse Pointe Woods, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/470,548

(22) Filed: Dec. 22, 1999

(51) Int. Cl.[7] ..... F02M 1/00
(52) U.S. Cl. ..... 123/470; 123/478; 701/105
(58) Field of Search ..... 123/478, 480; 701/105

(56) References Cited

U.S. PATENT DOCUMENTS 5,021,959 * 6/1991 Jundt et al. ..... 701/105
5,425,339 * 6/1995 Fukui ..... 123/478
5,699,254 * 12/1997 Abate et al. ..... 701/105
5,732,381 * 3/1998 Guido et al. ..... 701/105
5,934,255 * 8/1999 Dalton et al. ..... 123/478
5,983,876 * 11/1999 Irons et al. ..... 123/478
6,092,510 * 6/2000 Przymusinski et al. ..... 123/478

OTHER PUBLICATIONS

LM 1949 Injector Drive Controller, National Semiconductor Corporation, Feb. 1995, pp. 1–10.
Multifunction Injection Interface, SGS–Thomson Microelectronics, Nov. 1988, pp. 1–13.

* cited by examiner

*Primary Examiner*—John Kwon
(74) *Attorney, Agent, or Firm*—Jennifer Stec

(57) ABSTRACT

A system for controlling a fuel injector in accordance with an injection control strategy for an engine includes programmable control logic to provide selectable threshold signals for comparator circuits and/or control logic configured to receive various control signals in the control circuit and determine one or more timing signals. The programmable control logic allows the drive circuit to be modified, without changing any hardware, to accommodate injectors having different characteristics and to change the pulse modulation strategy. The control logic that receives the control signals produces injection timing signals to allow enhanced monitoring and control over the fuel injection process.

10 Claims, 3 Drawing Sheets

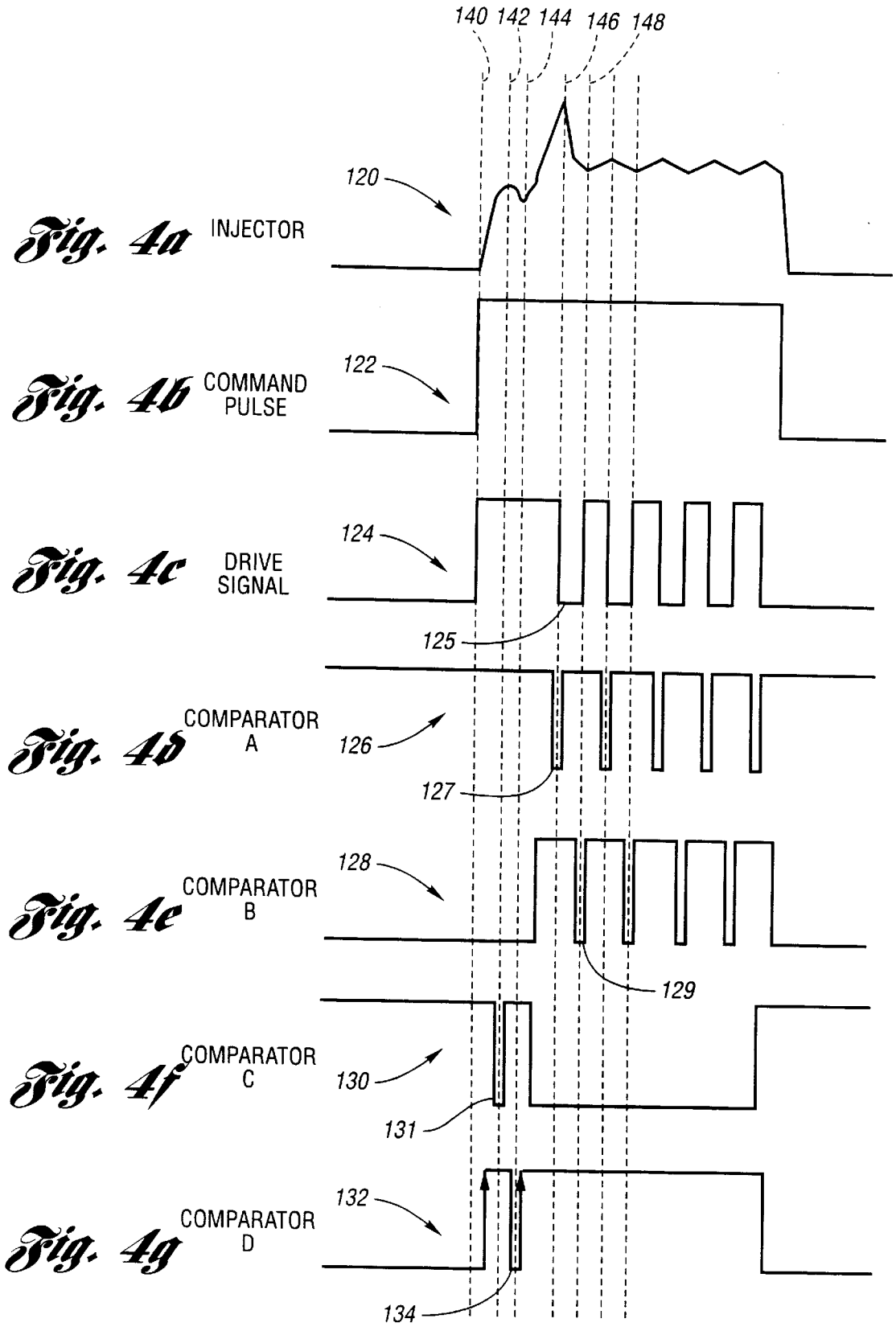
140 142 144 146 148
120
Fig. 4a INJECTOR
122
Fig. 4b COMMAND PULSE
124
Fig. 4c DRIVE SIGNAL
125
Fig. 4d COMPARATOR A
126
127
Fig. 4e COMPARATOR B
128
129
Fig. 4f COMPARATOR C
130
131
Fig. 4g COMPARATOR D
132
134

SYSTEM FOR CONTROLLING A FUEL INJECTOR

TECHNICAL FIELD

The present invention relates to a system for controlling a fuel injector for an internal combustion engine including a controller in communication with a current driver connected to the injector.

BACKGROUND ART

An internal combustion engine includes an engine block defining a plurality of cylinders, with an injector located at each cylinder. Fuel injectors are fed by one or more, high or low pressure pumps, as is well known in the art of fuel injection systems. The use of the electronically controlled fuel injector has become widespread. This type of fuel injector is in communication with the engine controller, and the engine controller generates a command signal to demand the initiation of the injection event. In response to the command signal, a current driver connected to an injector supplies current. Because fuel injection control strategies are complex, sometimes a sensing element is used to provide a signal indicative of the injector current during fuel injection.

A control circuit monitors the current detected by the sensing element, and controls the current driver in accordance with the injection strategy. Monitoring the current through the sensing element allows, for example, detection of the current inflection that occurs as the injector opens. Further, for example, monitoring the injector current allows the use of an injection control strategy in which a full current drive is used to open the injector, but then a pulse width modulated drive signal is used to maintain the injector in the open state. Although the full strength drive signal is needed to open the injector, the pulse width modulated signal through the bulk of the injection event has is been found to reduce power dissipation.

Many times, different injectors require slightly different control strategies in order to provide acceptable performance. For example, the inflection in the injector current that is known to indicate that the injector has opened may have different characteristics for different injectors. For example, voltage levels near the inflection point may vary from injector to injector, and particularly from manufacturer to manufacturer. Further, for example, due to the construction of the injector, different injectors may require different duty cycles for the pulse width modulated portion of the injector drive signal. In an existing fuel injection control systems and drive circuits, changing an injector means that the drive circuitry hardware must be modified so as to be suitable for the characteristics of the new injector. Further, aside from current detection, existing control systems do not have much functionality besides direct current sensing.

For the foregoing reasons, there is a need for a system for controlling a fuel injector that may be made to accommodate different injectors having different performance characteristics with less difficulty than the systems and drive circuits existing today, and that has added functionality compared to the existing systems.

DISCLOSURE OF INVENTION

It is, therefore, an object of the present invention to provide a system for controlling a fuel injector including programmable control logic configured to provide a threshold signal indicative of a threshold current for the injector with the control logic being programmable to allow selection of the threshold current for the particular injector.

It is another object of the present invention to provide a system for controlling a fuel injector including comparator and logic circuits, and control logic configured to receive and process control signals from the logic circuit to determine an injection timing signal.

In carrying out at least one of the above objects, a system for controlling a fuel injector in accordance with an injection control strategy for an internal combustion engine is provided. The engine includes a controller in communication with a current driver connected to the injector. The controller commands injection by generating a command signal. The current driver is connected to a sensing element that provides an injector signal indicative of the injector current. The system comprises programmable control logic and a comparator circuit. The programmable control logic is configured to provide a threshold signal indicative of a threshold current for the injector. The control logic is programmable to allow selection of the threshold current. The comparator circuit includes a comparator that receives and compares the injector signal to the threshold signal. The comparator provides an output signal based on the comparison to allow the injector to be controlled based on the comparison.

In a preferred embodiment, the system further comprises a digital-to-analog converter receiving a plurality of digital signals from the controller. The controller includes the programmable control logic for determining the plurality of digital signals. The converter has an analog output for providing the threshold signal as an analog voltage.

In some embodiments, the comparator circuit includes a detection portion for detecting an inflection in the injector current. The programmable control logic provides a first threshold signal indicative of an upper characteristic threshold current for the injector and a second threshold signal indicative of a lower characteristic threshold current for the injector. The detection portion comprises a first comparator and a second comparator. The first comparator receives and compares the injector signal to the first threshold signal, and provides an output based on the comparison. The second comparator receives and compares the injector signal to the second threshold signal, and provides an output based on the comparison.

In some embodiments, the comparator circuit includes a modulation portion for modulating the injector current. The programmable control logic provides an upper limit threshold signal indicative of an upper limit threshold current for the injector and a lower limit threshold signal indicative of a lower limit threshold current for the injector. The modulation portion comprises a first comparator and a second comparator. The first comparator receives and compares the injector signal to the upper limit threshold signal, and provides an output based on the comparison. The second comparator receives and compares the injector signal to the lower limit threshold signal, and provides an output based on the comparison.

Further, in carrying out at least one of the above objects, an internal combustion engine including a fuel injector and an engine controller for controlling the engine is provided. The engine controller controls the fuel injector in accordance with an injection control strategy. The controller is in communication with a current driver connected to the injector, and the controller commands injection by generating a command signal. The current driver is connected to a sensing element that provides an injector signal indicative of the injector current. The engine further comprises programmable control logic and a comparator circuit. The control logic is configured to provide a threshold signal indicative of a threshold current for the injector. The control logic is programmable to allow selection of the threshold current. The comparator circuit includes a comparator that receives and compares the injector signal to the threshold signal and provides an output signal based on the comparison to allow the injector to be controlled based on the comparison.

Further, in carrying out at least one of the above objects, a method for controlling a fuel injector in accordance with an injection control strategy for an internal combustion engine is provided. The method comprises selecting a threshold current for the injector, and programming control logic to provide a threshold signal indicative of the threshold current for the injector. The control logic is programmable to allow selection of the threshold current. The method further comprises comparing the injector signal to the threshold signal, and controlling the injector based on the comparison.

Further, in carrying out at least one of the above objects, a system for controlling a fuel injector in accordance with an injection control strategy for an internal combustion engine is provided. The engine includes a controller in communication with the current driver connected to the injector. The controller commands injection by generating a command signal. The current driver is connected to a sensing element that provides an injector signal indicative of the injector current. The system comprises a comparator circuit, a logic circuit, and control logic. The comparator circuit receives and compares the injector signal to a plurality of threshold signals and provides a plurality of output signals based on the comparisons. The logic circuit receives the plurality of output signals, and processes the plurality of output signals to produce a plurality of control signals. The control signals include a drive signal that is fed to the current driver. The control logic is configured to receive at least one of the control signals and to process the at least one control signal to determine an injection timing signal. The injection timing signal is provided to the controller to allow the injection control strategy to be modified based on the injection timing signal.

Further, in carrying out at least one of the above objects, an internal combustion engine is provided. The engine includes a fuel injector and an engine controller. The engine further comprises a comparator circuit that receives and compares the injector signals to a plurality of threshold signals, and a logic circuit receiving a plurality of comparator output signals. The logic circuit processes the comparator output signals to produce a plurality of control signals including a drive signal that is fed to the current driver. The engine further comprises control logic configured to receive at least one of the control signals and to process the at least one control signal to determine an injection timing signal.

In preferred embodiments, the logic circuit further comprises a field programmable gate array. Further, in preferred embodiments, the logic circuit is composed of a digital logic circuit including a plurality of D flip-flops. Preferably, at least a portion of the control logic is contained within the field programmable gate array.

Further, in carrying out at least one of the above objects, a system for controlling a fuel injector in accordance with an injection control strategy is provided. The system comprises a first comparator receiving and comparing the injector signal to a first threshold signal indicative of an upper characteristic threshold current for the injector during an injector current inflection. A second comparator receives and compares the injector signal to a second threshold signal indicative of a lower characteristic threshold current for the injector during the injector current inflection. A logic circuit receives the first and second comparator output signals, and processes the output signals to produce a plurality of control signals including a drive signal that is fed to the current driver. The system further comprises control logic configured to receive at least one of the control signals and to process the at least one control signal to determine an injection timing signal.

Preferably, the system further comprises a third comparator receiving and comparing the injector signal to an upper limit threshold signal indicative of an upper limit threshold current for the injector during an injector current modulation. More preferably, a forth comparator receives and compares the injector signal to a lower limit threshold signal indicative of a lower limit threshold current for the injector during an injector current modulation.

The advantages associated with embodiments of the present invention are numerous. For example, embodiments of the present invention allow the threshold current levels detected by the various comparators in a comparator circuit to be adjusted without requiring any hardware changes. In preferred embodiments, a serial peripheral interface allows the controller to communicate with the digital-to-analog converter. The controller may be programmed with an appropriate diagnostics tool to set the various threshold levels for the various comparators. Advantageously, threshold currents for the current inflection and for the pulse width modulated portion of the drive signal may be modified through software in embodiments of the present invention. In other embodiments, one or more timing signals are determined by control logic by process various control signals in the overall injector control logic. Advantageously, the injection timing signals may be provided to the controller so that the controller may modify the injection control strategy based on the received timing signals. Other advantages include the fact that the timing signals may be logged so that, in the event of an engine performance problem, the log may be examined to determine various characteristics of the injection system. Further, a diagnostic tool may be connected to the controller in one implementation, and the injection timing signals may be monitored as the engine is running to perform diagnostic tests.

The above objects and other objects, features, and advantages of the present invention are readily apparent from the following detailed description of the best mode for carrying out the invention when taken in connection with the accompanying drawings.

BRIEF DESCRIPTION OF DRAWINGS

FIGS. 4A–4G illustrate the relationships of the various control signals during an injection event using the exemplary circuit of the present invention shown in FIG. 2.

BEST MODES FOR CARRYING OUT THE INVENTION

Figure 1:
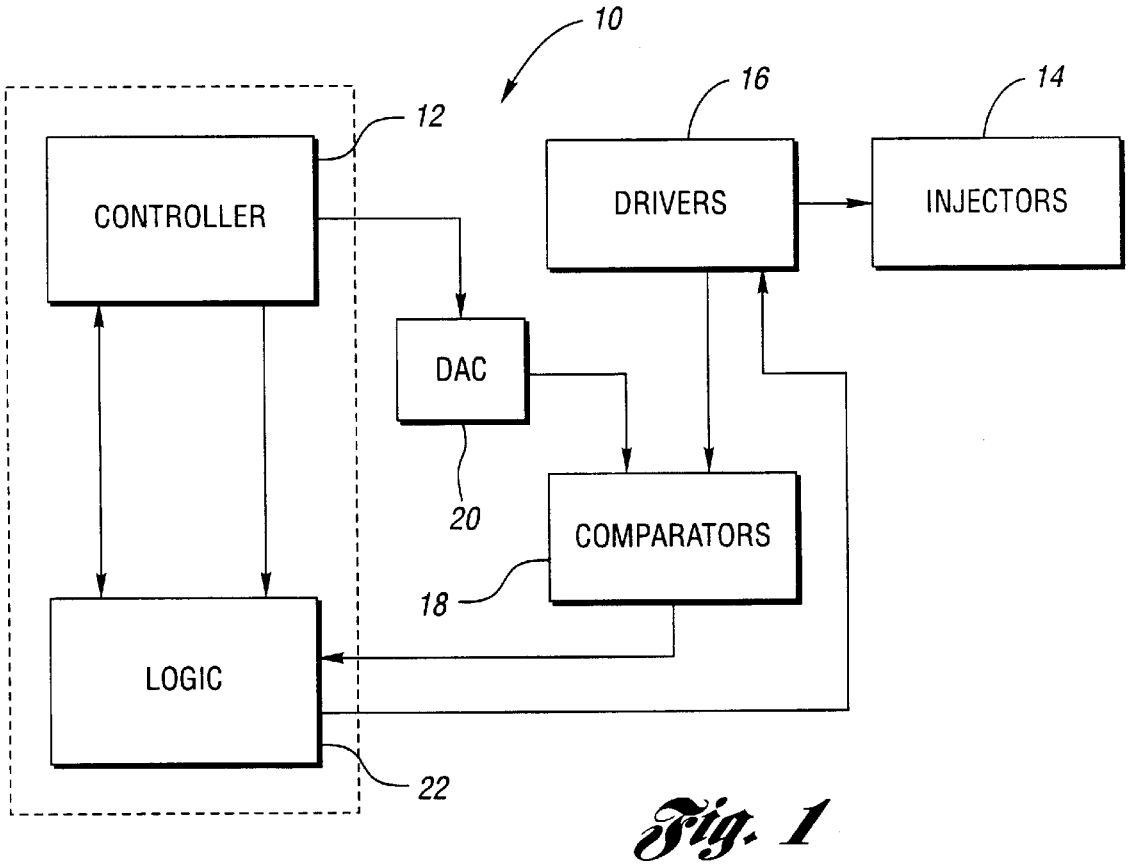
FIG. 1 is a block diagram illustrating a preferred system of the present invention that utilizes both the programmable threshold currents of the present invention and the timing signal control logic of the present invention.

With reference to FIG. 1, a system for controlling a fuel injector is generally indicated at 10. A controller 12 performs the controlling of many engine systems and subsystems as is known in the art, and in accordance with the present invention, generates a command pulse to demand injection. The injectors are indicated at block 14, with the current driver circuits indicated at 16. Drivers 16 supply current to injectors 14 upon receiving a command signal originating from controller 12. The command signal is communicated from the controller 12 to a current driver 16, in the illustrated embodiment, by control logic 22. That is, control logic 22 receives a command from controller 12 and then sends a command to driver 16. Comparators 18 monitor injector drive currents, and in accordance with the present invention, compare injector drive currents to threshold currents indicated by the analog output signal of digital-to-analog converter 20.

Controller 12 is programmable in that the digital outputs from controller 12 to DAC 20 may be modified without changing any hardware in the system. DAC 20, in turn, provides the threshold currents to comparators 18. The outputs of comparators 18 is routed to logic 22. In accordance with another aspect of the present invention, logic 22 processes the received signals, and produces a plurality of control signals including at least one timing signal. The injection timing signals represent various timing characteristics of the injection event such as, for example, injector opening time. Logic 22 and controller 12 cooperate to analyze the various control signals and control the injection events. Of course, it is appreciated that the various components shown in FIG. 1 may be intermixed with each other and do not operate in isolation. A better understanding of component cooperation may be readily understood with reference to FIG. 2.

Figure 2:
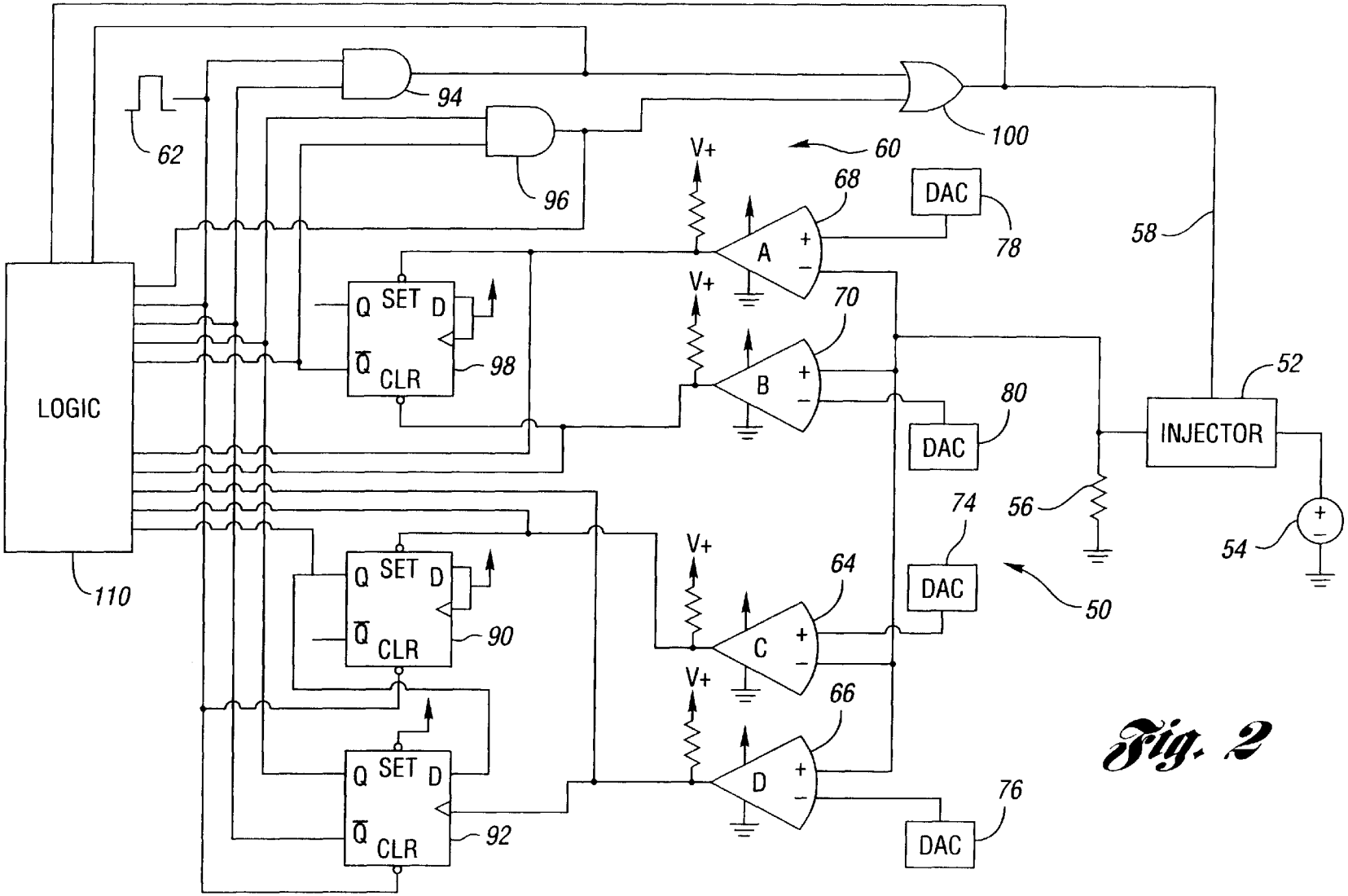
FIG. 2 is a circuit diagram illustrating an exemplary implementation of both the programmable threshold levels of the present invention and the timing signal control logic of the present invention.

In FIG. 2, an exemplary embodiment of the present invention is illustrated. It is appreciated that the circuit shown in FIG. 2 are an exemplary technique for implementing system 10 (FIG. 1). That is, specific arrangements of the comparator circuit and logic circuit in FIG. 2 are exemplary, and various changes may be made to the circuit as is appreciated by those skilled in the electronic arts. The overall circuit is generally indicated at 50, and an injector is indicated at 52. Injector 52 is turned on with current drawn from source or vehicle battery 54 in response to command pulse 62. A suitable element for sensing the drive current for injector 52 is a resistor 56. Resistor 56 provides a voltage difference indicative of current drawn by injector 52, when an injector drive signal is received along line 58. As is further described later herein, the drive signal on line 58 is the output of digital logic circuit 60, which includes gates 94, 96, 100.

The voltage developed across resistor 56 produces a signal indicative of the injector drive current, and that voltage signal is presented to the comparator circuit. A first portion of the comparator circuit includes comparators 64 and 66 (or C and D). Comparators 64 and 66 detect the current inflection that occurs as injector 52 reaches the open position after receiving a drive signal at line 58. The exemplary comparator circuit also includes another portion, made up of comparators 68 and 70 (or A and B). Comparators 68 and 70 control the pulse width modulated portion of the drive signal.

In accordance with the present invention, each comparator 64, 66, 68, 70, in a comparator circuit of a fuel injector control system has a threshold voltage (the threshold input is the other input besides the voltage from resistor 56) that is programmable. Advantageously, programmable control logic is configured to provide (for each comparator) a threshold signal indicative of a threshold current for the injector. In a preferred embodiment, the threshold voltages are the outputs from a digital-to-analog convertor connected to main controller 12 (FIG. 1) by a serial peripheral interface. As shown in FIG. 2, DAC outputs 74, 76, 78, and 80 provide the threshold signals for comparators 64, 66, 68, 70, respectively.

In accordance with the present invention, DAC outputs 74 and 76 may be set at the upper and lower thresholds to detect the current inflection of the injector current upon opening, while DAC outputs 78 and 80 may be set to control the pulse width modulation for the main portion of the injection event. As further shown in FIG. 2, comparators 64 and 66 have outputs connected to D flip-flops 90 and 92, respectively. D flip-flop 90 is set at the first part of the inflection, while the second part of the current inflection causes D flip-flop 92 to clock the output of D flip-flop 90 through D flip-flop 92. This switches switch logic circuit 60 such that a pulse width modulated output is passed to the injector (instead of the command signal 62). Comparators 68 and 70, during the pulse width modulation routine, repeatedly set and clear D flip-flop 98 to produce a pulse width modulated signal, passing through logic circuit 60, to line 58, and to injector 52. In accordance with another aspect of the present invention, control logic 110 receives the various control signals through circuit 50, and processes those signals to determine injection timing signals. Advantageously, the injection control strategy may be modified based on the injection timing signals, potentially in real-time. That is, it is appreciated that logic circuit 50 provides a number of different signals that all describe the injection event. These signals can be monitored, and time may be measured and used to control/adjust the injection control strategy.

Figure 3:
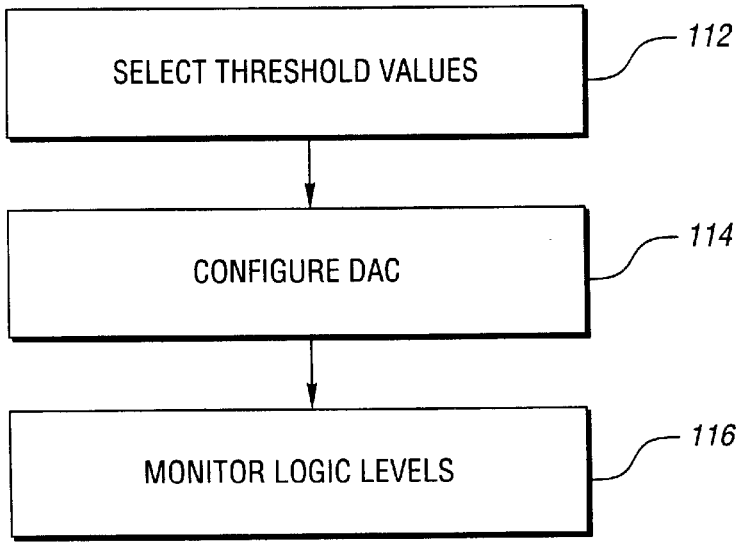
FIG. 3 is a block diagram illustrating setting threshold values, and subsequently monitoring logic levels in a control circuit.

In FIG. 3, a control circuit is configured. At block 112, threshold values are selected. At block 114, the DAC is configured via the controller software. At block 116, control signal logic levels are monitored, and used to control/modify the injection strategy based on various time measurements made by the control logic, and possibly involving some processing by the controller.

With reference to FIGS. 4A-4G, the injector current, and various control signals are depicted for a single injection event. The exemplary embodiment of the present invention that uses the circuits shown in FIG. 2, when viewed together with the various signal graphs of FIGS. 4A–4G illustrates the behavior a number of the control signals, and facilitates an overall understanding of the fuel injection control strategy. In FIG. 4A, the injector drive current is generally indicated at 120. In FIG. 4B, the command pulse (62, FIG. 2) is generally indicated at 122. In FIG. 4C, the drive signal is generally indicated at 124. In FIG. 4D, the output of comparator A (68, FIG. 2) is generally indicated at 126. In FIG. 4E, the output of comparative B (70, FIG. 2) is generally indicated at 128. In FIG. 4F, the output of comparator C (64, FIG. 2) is generally indicated at 130. In FIG. 4G, the output of comparator D (66, FIG. 2) is generally indicated at 132. Various instants during the injection event are indicated at vertical dashed lines 140, 142, 144, 146, 148, 150, 152.

With continuing reference to FIGS. 2 and 4A–4G, operation of circuit 50 will now be described. The controller generates the command pulse to demand an injection event. The entire injection event begins with the rising edge of the command pulse at time 140, and terminates at the falling edge of the command pulse. As the injector current begins to rise, drive signal line 58 results from the command pulse, as determined by logic circuit 60. Comparator D is the first comparator to change states, but this initial state change does not have any significant effect. At the beginning of the current inflection at time 142, comparator C toggles 131 low and then back high, presetting the output of D flip-flop 90. At the end portion of the inflection, at time 144, comparator D toggles 134 to low and then back high again, clocking the D flip-flop 92 to change the input signals of the logic circuit 60. The input signals of logic circuit 60 change such that line 58 now reflects the signal from D flip-flop 98 (instead of the command signal 62). The command signal 62 is now blocked at gate 94, while the output of the D flip-flop 98 passes through gate 96. When pulse 62 ends, D flip-flops 90, 92 are cleared.

With comparators A and B (68 and 70) now controlling injector operation for the pulse width modulated portion of the drive signal 124, the first comparator that changes states is comparator B, but this first state change has no significant effects. At time 146, comparator A toggles 127 low, and then back to high, setting the output of D flip-flop 98, and blocking the signal from D flip-flop 92 at gate 96, to result in the off-portion 125 of the duty cycle for the drive signal. Injector current then decreases, as detected by element 56, until time 148, where comparator B toggles 129 low (and then high again). When the output of comparator B goes low, D flip-flop 98 is cleared, allowing the (high) signal from D flip-flop 92 to pass through gate 96, gate 100, to injector 52. Comparators A and B continue to toggle, with the low output signal causing D flip-flop 98 to change states, resulting in a pulse width modulated signal. Advantageously, in accordance with the present invention, the voltages at DAC output 78 and 80 may be programmed to produce the desired switching voltages.

It is to be appreciated that embodiments of the present invention have many advantages. In some embodiments, comparator switching voltages or threshold voltages may be programmed with the controller software to vary the digital outputs to a digital-to-analog converter, allowing the analog threshold voltage to be selected in software. Advantageously, different injectors may readily be substituted for the existing injectors, and only a software change is required as opposed to changing any of the hardware.

Further, other embodiments of the present invention provide a digital logic circuit that manipulates the outputs of the plurality of comparators. The digital logic circuit, in the example, includes a number of D flip-flop and logic gates, preferably contained within a field programmable gate array. Of course, the logic circuit may take many forms. Advantageously, by providing a logic circuit, various control signals may be monitored by system control logic to provide feedback as to injector performance. The control logic may be operative to determine injector timing signals, that is, time different events of the injection such as current ramp-up time, etc.

Advantageously, the control logic and logic circuit, preferably implemented as a field programmable gate array, allow time signals and measurements to control various features of the injection strategy. Further, the logic circuit embodiments of the present invention may enjoy the greatest benefit when employed together with the programmable control logic for selecting threshold voltages of the present invention, with an example of the two embodiments implemented together being shown in FIG. 2.

While the best mode for carrying out the invention has been described in detail, those familiar with the art to which this invention relates will recognize various alternative designs and embodiments for practicing the invention is defined by the following claims.

What is claimed is:

1. A system for controlling a fuel injector in accordance with an injection control strategy for an internal combustion engine including a controller in communication with a current driver connected to the injector, the controller commanding injection by generating a command signal, the current driver being connected to a sensing element that provides an injector signal indicative of the injector current, the system comprising:

a comparator circuit that receives and compares the injector signal to a plurality of threshold signals and provides a plurality of output signals based on the comparisons;

a logic circuit receiving the plurality of output signals, and processing the plurality of output signals to produce a plurality of control signals including a drive signal that is fed to the current driver; and control logic configured to receive at least one of the control signals and to process the at least one control signal to determine an injection timing signal, the injection timing signal being provided to the controller and allowing the injection control strategy to be modified by the controller based on the injection timing signal.

2. The system of claim 1 wherein the logic circuit further comprises:

a field programmable gate array.

3. The system of claim 2 wherein the logic circuit further comprises:

a digital logic circuit including a plurality of D flip-flops.

4. The system of claim 2 wherein at least a portion of the control logic is contained within the field programmable gate array.

5. An internal combustion engine including a fuel injector and an engine controller for controlling the engine, including controlling the fuel injector in accordance with an injection control strategy, the controller being in communication with a current driver connected to the injector, the controller commanding injection by generating a command signal, the current driver being connected to a sensing element that provides all injector signal indicative of the injector current, the engine further comprising:

a comparator circuit that receives and compares the injector signal to a plurality of threshold signals and provides a plurality of output signals based on the comparisons;

a logic circuit receiving the plurality of output signals, and processing the plurality of output signals to produce a plurality of control signals including a drive signal that is fed to the current driver; and control logic configured to receive at least one of the control signals and to process the at least one control signal to determine an injection timing signal, the injection timing signal being provided to the controller and allowing the injection control strategy to be modified by the controller based on the injection timing signal.

6. The engine of claim 5 wherein the logic circuit further comprises:

a field programmable gate array.

7. The engine of claim 6 wherein the logic circuit further comprises:

a digital logic circuit including a plurality of D flip-flops.

8. The engine of claim 6 wherein at least a portion of the control logic is contained within the field programmable gate array.

9. A system for controlling a fuel injector in accordance with an injection control strategy for an internal combustion engine including a controller in communication with a current driver connected to the injector, the controller commanding injection by generating a command signal, the current driver being connected to a sensing element that provides an injector signal indicative of the injector current, the system comprising:

a first comparator receiving and comparing the injector signal to a first threshold signal indicative of an upper characteristic threshold current for the injector during an injector current inflection, and providing a first output based on the comparison;

a second comparator receiving and comparing the injector signal to a second threshold signal indicative of a lower characteristic threshold current for the injector during the injector current inflection, and providing a second output based on the comparison;

a logic circuit receiving the first and second output signals, and processing the first and second output signals to produce a plurality of control signals including a drive signal that is fed to the current driver; and control logic configured to receive at least one of the control signals and to process the at least one control signal to determine an injection timing signal, the injection timing signal being provided to the controller and allowing the injection control strategy to be modified by the controller based on the injection timing signal.

10. The system of claim 9 further comprising:

a third comparator receiving and comparing the injector signal to an upper limit threshold signal indicative of an upper limit threshold current for the injector during an injector current modulation, and providing a first output based on the comparison; and a fourth comparator receiving and comparing the injector signal to a lower limit threshold signal indicative of a lower limit threshold current for the injector during an injector current modulation, and providing a second output based on the comparison.

* * * * *